US009086066B2

(12) United States Patent
Moetakef et al.

(10) Patent No.: US 9,086,066 B2
(45) Date of Patent: Jul. 21, 2015

(54) VACUUM PUMP WITH ROTOR-STATOR POSITIONING TO PROVIDE NON-RETURN

(71) Applicant: Ford Global Technologies, LLC, Dearborn, MI (US)

(72) Inventors: Mohammad Ali Moetakef, West Bloomfield, MI (US); Steve Poe, Canton, MI (US); Abdelkrim Zouani, Canton, MI (US); Jonathan Denis Crowe, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 229 days.

(21) Appl. No.: 13/779,473

(22) Filed: Feb. 27, 2013

(65) Prior Publication Data

US 2014/0241928 A1 Aug. 28, 2014

(51) Int. Cl.

| | |
|---|---|
| ***F04C 15/00*** | (2006.01) |
| ***F04C 18/00*** | (2006.01) |
| ***F04C 2/00*** | (2006.01) |
| ***F04C 25/02*** | (2006.01) |
| ***F04C 29/12*** | (2006.01) |
| ***F04C 18/344*** | (2006.01) |

(52) U.S. Cl.

CPC ..... *F04C 2/00* (2013.01); *F04C 18/3441* (2013.01); *F04C 25/02* (2013.01); *F04C 29/12* (2013.01); *F04C 2240/20* (2013.01)

(58) Field of Classification Search

CPC ..... F04C 2/00; F04C 25/02; F04C 18/3441; F04C 29/12; F04C 2240/20

USPC ..... 418/104, 259–269

See application file for complete search history.

(56) References Cited

U.S. PATENT DOCUMENTS

| | | | | |
|---|---|---|---|---|
| 4,428,195 | A * | 1/1984 | Linder et al. | 60/397 |
| 5,954,489 | A * | 9/1999 | Kinoshita | 418/179 |
| 7,628,595 | B2 * | 12/2009 | Ono et al. | 418/255 |
| 8,267,678 | B2 | 9/2012 | Ohtahara et al. | |
| 2010/0028189 | A1 * | 2/2010 | Cadeddu | 418/259 |

FOREIGN PATENT DOCUMENTS

| | | | |
|---|---|---|---|
| WO | 2007003215 | A1 | 1/2007 |
| WO | 2009053012 | A2 | 4/2009 |

* cited by examiner

*Primary Examiner* — Hoang Nguyen

(74) *Attorney, Agent, or Firm* — Greg Brown; Alleman Hall McCoy Russell & Tuttle LLP

(57) ABSTRACT

A rotary-vane vacuum pump comprises a stator and a vaned rotor, the stator partly defining an outlet chamber and including an outlet passage opening to the outlet chamber. The rotor is rotatably sealed to the stator; it has a sealing area to block the outlet passage, and, an unsealing area alignable with the outlet passage by rotation of the rotor to periodically unblock the outlet passage. The disclosed pump offers reduced resistance to lubricant oil discharge from the outlet passage, which results in lower differential pressure between inlet and outlet chambers at the end of the pumping cycle.

19 Claims, 5 Drawing Sheets

VACUUM PUMP WITH ROTOR-STATOR POSITIONING TO PROVIDE NON-RETURN

TECHNICAL FIELD

This application relates to the field of motor-vehicle engineering, and more particularly, to a vacuum pump for a motor-vehicle engine system.

BACKGROUND AND SUMMARY

A motor-vehicle engine system may include a vacuum pump to evacuate air from one or more motor-vehicle components. Such components may include a vacuum servo booster for hydraulic brakes, a throttle driver, or an actuated damper in the ventilation system of the vehicle, for example.

The vacuum pump of a motor-vehicle engine system is typically a rotary-vane type positive-displacement pump. International Patent Publication Number WO2007/003215A1 shows one example of this type of pump. The pump includes a single-vane rotor that rotates within a stator and divides the interior volume of the stator into non-communicating chambers. Such chambers include an inlet chamber and an outlet chamber. The stator has an inlet passage that communicates with the inlet chamber, and an outlet passage that communicates with the outlet chamber. The rotor and stator are coated with a film of lubricant oil and configured so that each rotation of the rotor increases the volume of the inlet chamber and decreases the volume of the outlet chamber. Accordingly, air is admitted through the inlet passage and expelled through the outlet passage, providing the basic function of the vacuum pump. In this pump and others like it, a discrete non-return valve may be coupled to the outlet passage to minimize the amount of air that re-enters the pump at the beginning of each pumping cycle. The non-return valve may include a flexible, spring-loaded shutter, or reed-type element.

During operation of the vacuum pump, the spring-loaded shutter starts to open when the pressure in the outlet chamber overcomes the restoring (closing) force of the shutter. The inventors herein have found that the limited opening extent of the shutter, together with its somewhat large restoring force, results in excessive lubricant oil pressure in the outlet chamber at the end of each pumping cycle. Under some conditions, the high pressure of the outlet chamber relative to the inlet chamber causes misalignment or rocking of the rotor. This, in turn, may cause the rotor to impact the stator, resulting in objectionable noise from the vacuum pump.

Accordingly, one embodiment of the present disclosure provides a rotary-vane vacuum pump comprising a stator and a vaned rotor. The stator partly defines an outlet chamber and includes an outlet passage opening to the outlet chamber. The rotor is rotatably sealed to the stator. The rotor has a sealing area to block the outlet passage, and, an unsealing area alignable with the outlet passage by rotation of the rotor to periodically unblock the outlet passage. The disclosed pump offers reduced resistance to lubricant oil discharge from the outlet passage, which results in lower differential pressure between inlet and outlet chambers at the end of the pumping cycle. Therefore, the rotor is not subjected to misalignment or rocking forces that could result in objectionable noise from the pump.

The summary above is provided to introduce a selected part of this disclosure in simplified form, not to identify key or essential features. The claimed subject matter, defined by the claims, is limited neither to the content of this summary nor to implementations that address the problems or disadvantages noted herein.

DETAILED DESCRIPTION

Figure 1:
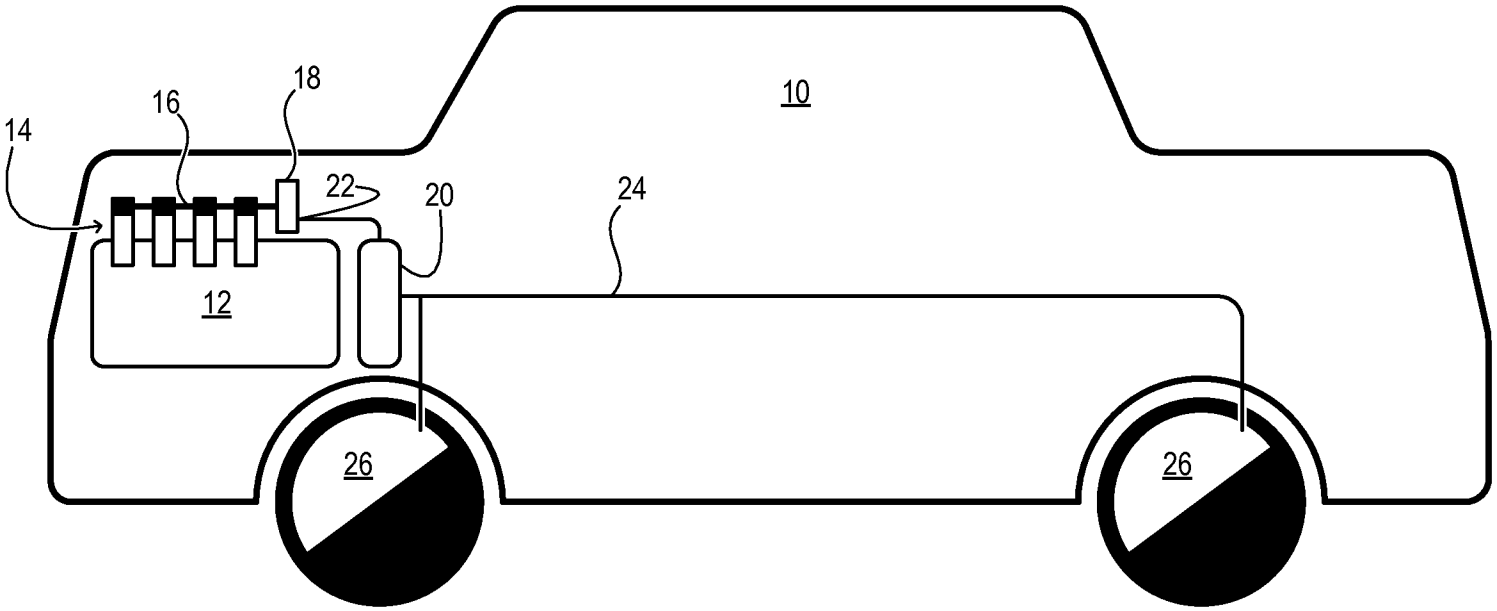
FIG. 1 schematically shows aspects of an example motor-vehicle system in accordance with an embodiment of this disclosure.

Aspects of this disclosure will now be described by example and with reference to the illustrated embodiments listed above. Components, process steps, and other elements that may be substantially the same in one or more embodiments are identified coordinately and are described with minimal repetition. It will be noted, however, that elements identified coordinately may also differ to some degree. The drawing figures included in this disclosure are schematic and generally not drawn to scale. Rather, the various drawing scales, aspect ratios, and numbers of components shown in the figures may be purposely distorted to make certain features or relationships easier to see.

FIG. 1 schematically shows aspects of an example motor vehicle 10. The motor vehicle includes an engine 12, which provides motive force to drive the vehicle. The engine includes a plurality of valves 14—intake and/or exhaust valves, for example—mechanically actuated via camshaft 16. The camshaft may be driven by the crankshaft of the vehicle (not shown in FIG. 1) via a belt, a chain, or other suitable componentry. In the embodiment of FIG. 1, the camshaft also drives vacuum pump 18. The vacuum pump is used to evacuate air from one or more evacuable motor-vehicle components during operation of the vehicle. Such components may include a vacuum servo booster for hydraulic brakes, a throttle driver, or an actuated damper in the ventilation system of the vehicle, for example. In the embodiment of FIG. 1, vacuum servo booster 20 is coupled to inlet 22 of the vacuum pump. Hydraulic lines 24 conduct hydraulic fluid to hydraulic brakes 26 of the motor vehicle.

Figure 2:
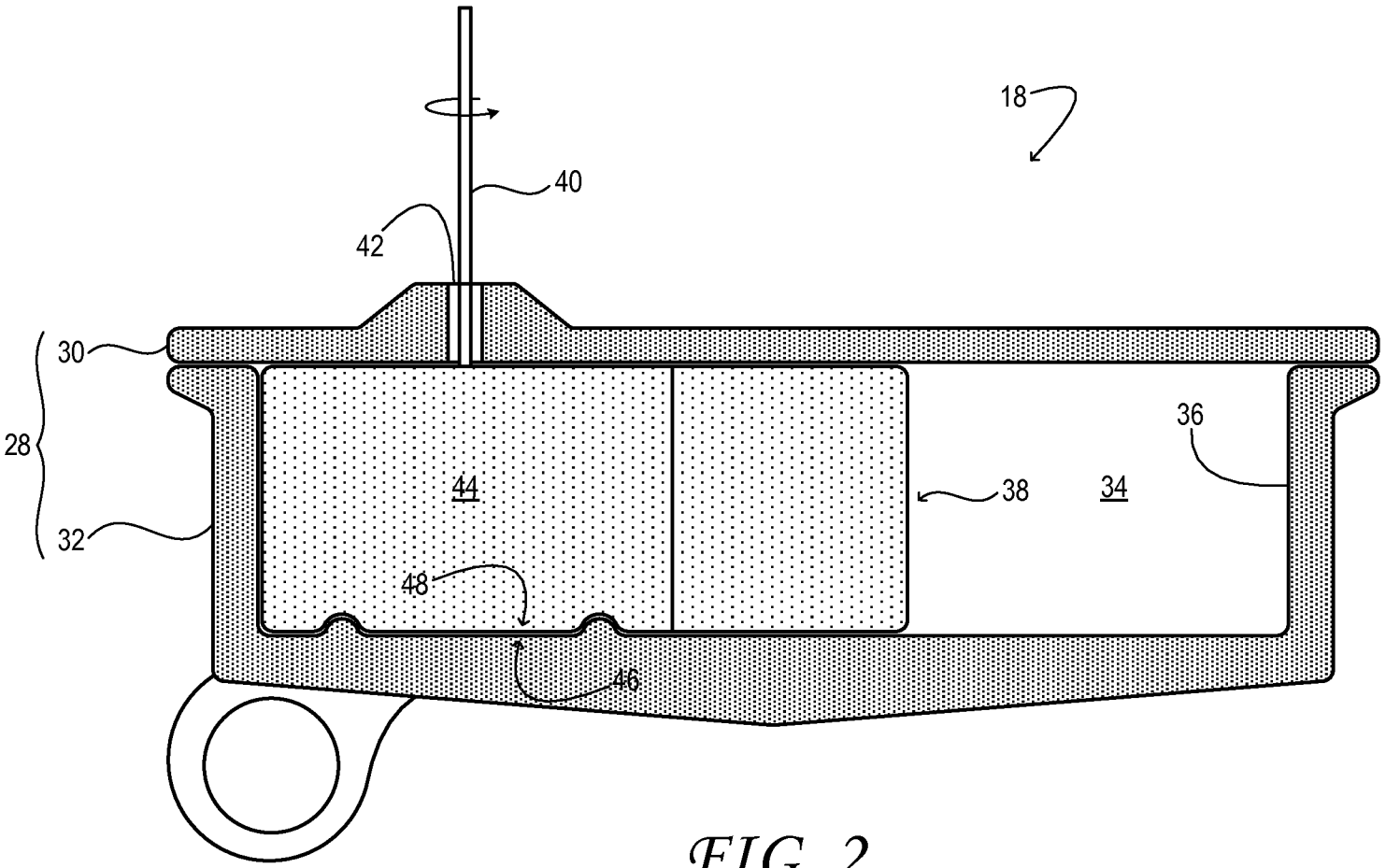
FIGS. 2, 3, and 4 show aspects of an example rotary-vane vacuum pump in accordance with an embodiment of this disclosure.

FIG. 2 shows aspects of an example rotary-vane vacuum pump 18 in one embodiment. The vacuum pump includes a housing, or stator, 28. In the illustrated embodiment, the stator is assembled from opposing front and back portions (30 and 32, respectively) that together enclose a cavity 34.

Stator 28 presents a curved interior wall 36 that surrounds a vaned rotor 38. In the drawings herein, the curved interior wall takes the form of a cylinder, but differently shaped curved interior walls may be used in other embodiments. As shown in FIG. 2, front and back sides of the rotor rotate against the front and back portions of the stator, respectively. The rotor is coupled to and driven by a shaft 40 that extends through an oil-lubricated, sealed bearing 42 in front portion 30 of the stator. In some examples, this shaft may be or be coupled to a motor-vehicle camshaft; in other examples, the shaft may be that of an electric motor driven by a battery/alternator in the motor vehicle.

Figure 3:
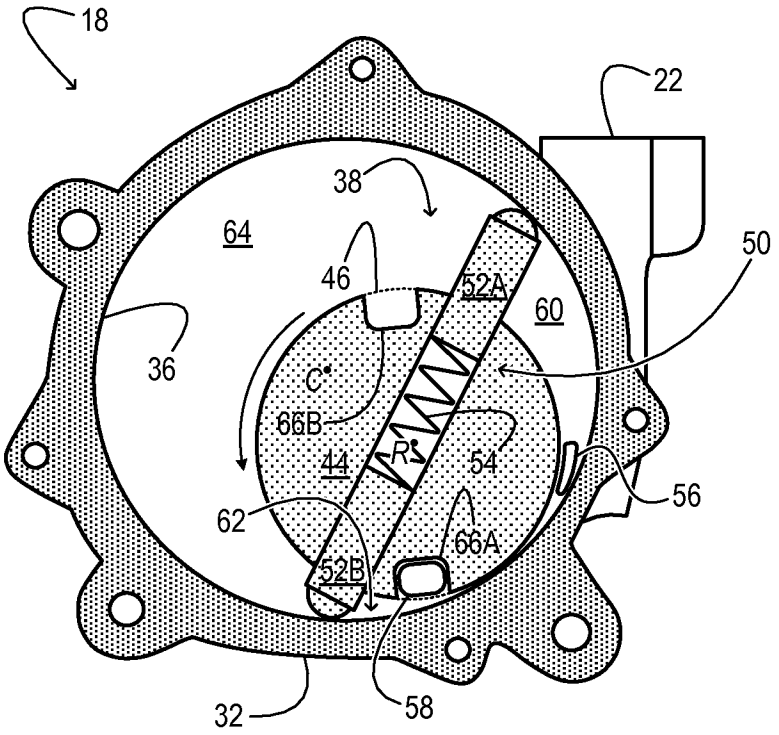

Continuing in FIG. 2, rotor 38 includes a disk-shaped rotor hub 44. As shown in the drawing, the rotor hub may rotate in bearing area 46 of back portion 32 of stator 28. The rotor, in turn, presents a complementary sealing area 48 to match the bearing area. In other words, the sealing area of the rotor is contiguous, and disposed in face-sharing contact, with the bearing area of the stator. In other examples, the bearing area may be formed in front portion 30 of the rotor instead of, or in addition to, back portion 32. In some embodiments, the bearing area in which the rotor rotates may be a recessed area. It may, for example, take the form of a disk-shaped detent in the front and/or back portion of the stator. In other embodiments, the rotor hub may include a recessed sealing area, and the stator may present an elevated (e.g., disk- or ring-shaped) bearing area to receive the recessed sealing area of the rotor. More generally, the stator may include any bearing area suitably shaped to receive the rotor, and the rotor may present a complementary sealing area 48 to match the bearing area. In this and other embodiments, a slidable but substantially airtight seal between the rotor and the stator is provided by a thin film of lubricant oil at each rotor-stator interface. The friction-reducing oil enables the rotor to move relative to the stator while maintaining the seal. FIG. 3 shows aspects of vacuum pump 18 from another perspective. The front portion 30 of stator 28 is omitted in FIG. 3 to reveal the internal structure of the vacuum pump. As shown in the drawing, rotor hub 44 contacts, rotates against, and slidably seals to curved interior wall 36. In addition to the rotor hub, rotor 38 includes a segmented vane 50 that slides freely along the diameter of the rotor hub. The vane has two end segments, 52A and 52B, separated by a spring 54. The spring biases each end segment against the curved interior wall, causing the end segments to slide along the curved interior wall as the rotor rotates. In the embodiment of FIG. 3, the rotor hub supports only one vane; in other embodiments, the rotor hub may support two or more vanes.

Stator 28 includes an inlet passage 56 and an outlet passage 58. The inlet passage opens to vacuum pump inlet 22, and the outlet passage opens to the air space outside the vacuum pump. In the embodiment illustrated in FIG. 3, rotor hub 44, vane 50, and curved interior wall 36 divide the internal cavity 34 of the stator into three variable-volume chambers: an inlet chamber 60 that communicates with the inlet passage, an outlet chamber 62 that communicates with the outlet passage, and a closed chamber 64 that communicates neither with the inlet passage nor with the outlet passage. Accordingly, the inlet chamber and the outlet chamber are each partly defined by the stator, inasmuch as the curved interior wall of the stator, together with the rotor hub and vane of the rotor, define the evolving boundaries of both the inlet chamber and the outlet chamber. Because the rotational axis R of rotor 38 is offset from the central axis C of the internal cavity, the volume of the inlet chamber increases as the rotor rotates in the direction shown in FIG. 3, while the volume of the outlet chamber decreases. This feature provides the basic function of vacuum pump 18, pumping air from vacuum pump inlet 22 to air space outside the vacuum pump.

In some vacuum pumps, the minimum inlet pressure may be limited by ingress of air through the outlet passage and into the cavity of the pump. One way to address this issue is to couple a non-return valve to the outlet passage to minimize the amount of air that re-enters the vacuum pump. One type of non-return valve may include a flexible, spring-loaded shutter, or reed-type element, with a low-clearance backstop to protect the shutter from irreversible deformation. During operation of the vacuum pump, the spring-loaded shutter starts to open when the pressure in the outlet chamber overcomes the restoring (closing) force of the shutter. The inventors herein have found, however, that the limited opening extent of the shutter, together with its somewhat large restoring force, results in excessive lubricant oil pressure in the outlet chamber at the end of each pumping cycle. Under some conditions, the high pressure of the outlet chamber relative to the inlet chamber may cause misalignment or rocking of the rotor. This, in turn, may cause the rotor to impact the stator, resulting in objectionable noise from the vacuum pump.

Figure 4:
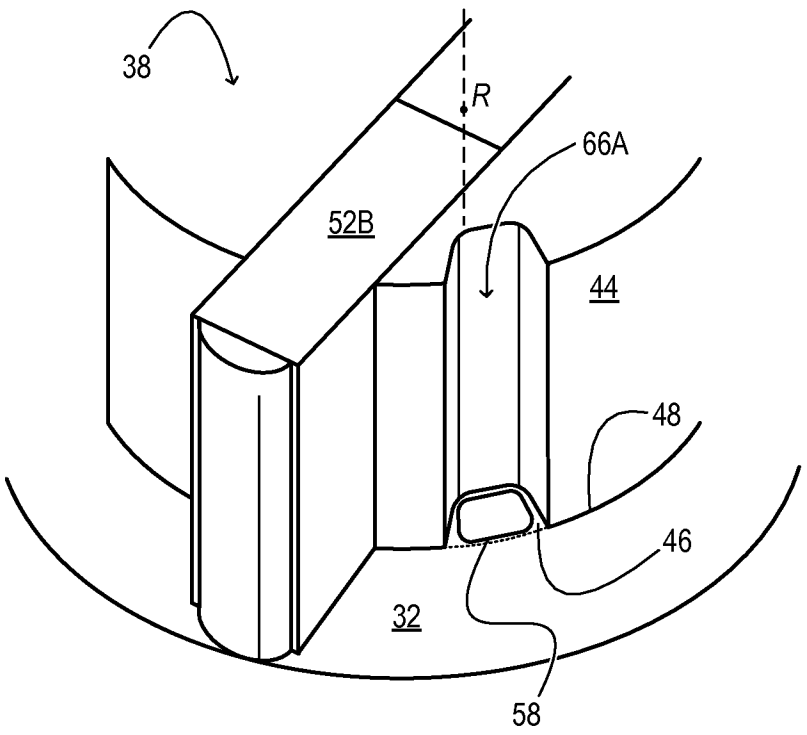

Accordingly, the present disclosure provides a non-return function at outlet passage 58 of vacuum pump 18, but without using a reed-type non-return valve. Instead, as shown in FIGS. 3 and 4, the outlet passage is positioned within bearing area 46 of the stator, where it remains covered by sealing area 48 of the rotor hub over most of the rotational range of the rotor. However, rotor hub 44 also includes, in addition to sealing area 48, two unsealing areas 66A and 66B. In the illustrated embodiment, the unsealing areas are arranged symmetrically on opposite sides of rotor vane 50. Each unsealing area is alignable with the outlet passage by rotation of the rotor to periodically unblock the outlet passage during rotation of the rotor. As shown in FIG. 3, one unsealing area is aligned with the outlet passage when outlet chamber 62 is at its lowest volume. The outlet passage is otherwise blocked by the sealing area of the rotor—i.e., over most of the rotational range of the rotor. Over the small range of angles where an unsealing area aligns with the outlet passage, the outlet passage becomes unblocked. When the outlet passage is unblocked, air and lubricant oil are expelled from the outlet chamber with relatively little back pressure. Although the illustrated embodiment provides two unsealing areas, this disclosure is equally consistent with embodiments having only one unsealing area.

Figure 6:
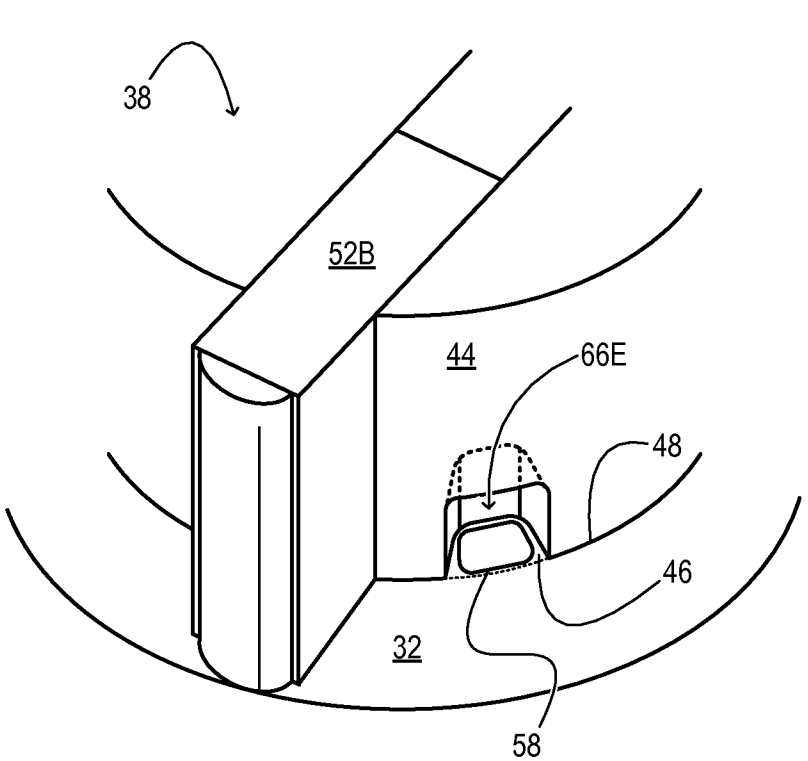
FIGS. 5, 6, and 7 show aspects of other example rotary-vane vacuum pumps in accordance with embodiments of this disclosure.
Figure 5:
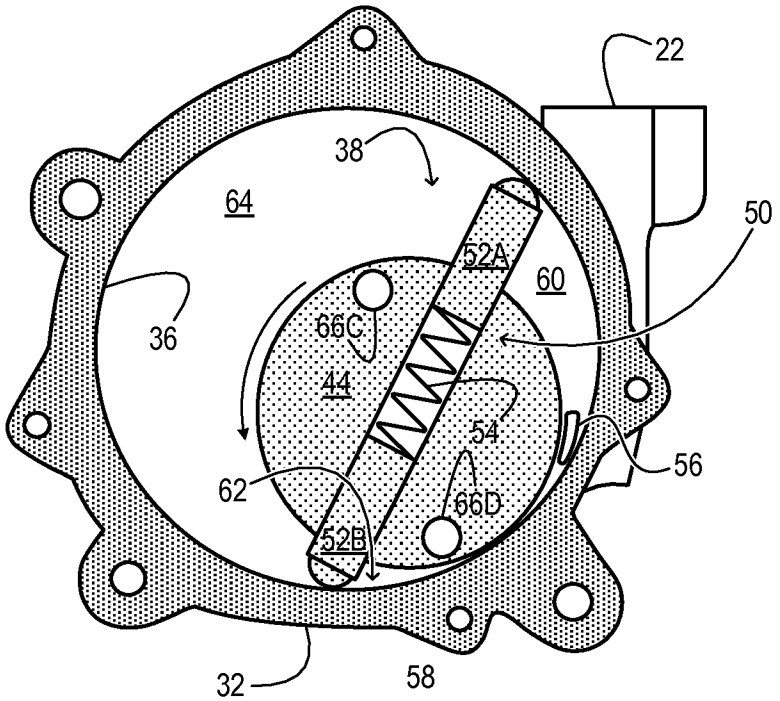
Figure 7:
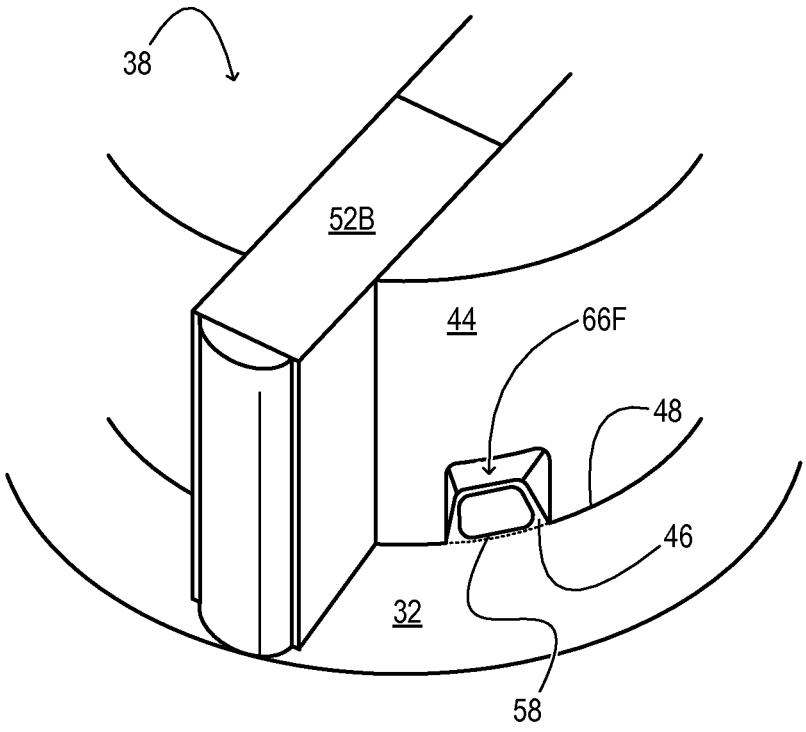

As shown in FIGS. 3 and 4, unsealing areas 66A and 66B may be formed as notches in sealing area 48. In these drawings, the notches go all the way through rotor hub 44. In some examples, each of the notches may be formed parallel to the rotational axis R of the rotor. The notches may have a rounded trapezoidal shape, as shown, or a more semicircular shape for compactness, or a more elongated, rectangular shape for less flow resistance. In this and other embodiments, outlet passage 58 may take the form of an oblong hole of substantially the same length and width as each of the notches. However, the particular geometry of the unsealing areas and outlet passages may differ in the various embodiments of this disclosure. For example, an unsealing area may include a thru-hole formed in the rotor hub, instead of a notch. One such example is shown in FIG. 5, with thru-holes 66C and 66D periodically unblocking a similarly shaped outlet passage (not shown in FIG. 5). In still other embodiments, the unsealing area may include a detent extending only part-way through the rotor. Here, detent 66E may directly face bearing area 46 presenting a concavity thereto, as shown by example in FIG. 6. Although the illustrated detent has a rounded trapezoidal shape, it will be appreciated that an alternatively shaped detent may be used without departing from the scope of this disclosure. In FIG. 7, for instance, detent 66F has a wedge shape. In still other examples, the detent may take the form of a spherical quadrant.

It will be understood that the articles, systems, and methods described hereinabove are embodiments of this disclosure—non-limiting examples for which numerous variations and extensions are contemplated as well. This disclosure also includes all novel and non-obvious combinations and subcombinations of the above articles, systems, and methods, and any and all equivalents thereof.

The invention claimed is:

1. A rotary-vane vacuum pump comprising:

a stator with an outlet passage, the stator partly defining an outlet chamber; and a vaned rotor rotatably sealed to the stator, the rotor having a sealing area to block the outlet passage, the sealing area contiguous with a bearing area of the stator, and an unsealing area alignable with the outlet passage by rotation of the rotor to periodically unblock the outlet passage, the unsealing area formed as a notch in the sealing area.

2. The pump of claim 1 wherein the notch extends all the way through the rotor.

3. The pump of claim 1 wherein the notch is formed as a detent extending only part-way through the rotor.

4. The pump of claim 1 wherein the outlet passage is unblocked only when aligned with the unsealing area.

5. The pump of claim 1 wherein the stator and the rotor are separated by a film of lubricant oil, and wherein air and lubricant oil are expelled from the outlet chamber when the outlet passage is unblocked.

6. The pump of claim 1 wherein the stator includes a curved interior wall, and wherein the rotor includes a rotor hub and a segmented, spring-loaded vane with two end segments that slidably seal against the curved interior wall.

7. The pump of claim 1 wherein the unsealing area is one of two unsealing areas arranged symmetrically on opposite sides of the vane.

8. The pump of claim 6 wherein an inlet chamber and the outlet chamber are each bounded by the rotor hub of the rotor, by the vane, and by the curved interior wall.

9. The pump of claim 8 wherein the inlet chamber increases in volume during rotation of the rotor, and wherein the outlet chamber decreases in volume during the rotation of the rotor, and wherein the unsealing area is aligned with the outlet passage when the outlet chamber is at its lowest volume.

10. The pump of claim 1 wherein the bearing area of the stator receives the sealing area of the rotor, and wherein the sealing area is slidably sealed against the bearing area via a film of lubricant oil.

11. The pump of claim 1 wherein the rotor is coupled to an electric motor in a vehicle.

12. The pump of claim 1 wherein the rotor is coupled to a camshaft of a motor-vehicle engine system.

13. The pump of claim 1, wherein the outlet passage is blocked by the sealing area when not aligned with the unsealing area.

14. The pump of claim 1 wherein the pump lacks a reed-type non-return valve.

15. A rotary-vane vacuum pump comprising:

a stator with a curved interior wall and an outlet passage;

a rotor rotatably sealed to the stator and separated from the stator by a film of lubricant oil, the rotor including a rotor hub and a segmented, spring-loaded vane and two opposite end segments that slidably seal against the curved interior wall of the stator, the rotor also including a sealing area to block the outlet passage, the sealing area contiguous with a bearing area of the stator, and two notches formed in the sealing area, each notch alignable with the outlet passage by rotation of the rotor to periodically unblock the outlet passage;

an inlet chamber bounded by the rotor hub of the rotor, by the vane, and by the curved interior wall, the inlet chamber increasing in volume during rotation of the rotor; and an outlet chamber bounded by the rotor hub of the rotor, by the vane, and by the curved interior wall, the outlet chamber decreasing in volume during the rotation of the rotor, such that one of the two notches is aligned with the outlet passage when the outlet chamber is at its lowest volume.

16. The pump of claim 15 wherein the outlet passage is an oblong hole of substantially the same length and width as each of the two notches.

17. A motor-vehicle system comprising:

an engine;

a rotary-vane vacuum pump with a stator and a vaned rotor, the stator partly defining an outlet chamber and including an outlet passage and an inlet passage, the rotor rotatably sealed to the stator and including a sealing area to block the outlet passage, the sealing area contiguous with a bearing area of the stator, and, an unsealing area alignable with the outlet passage by rotation of the rotor to periodically unblock the outlet passage, the unsealing area formed as a notch in the sealing area; and an evacuable motor-vehicle component coupled to the inlet passage, wherein the pump lacks a discrete non-return valve coupled to the outlet passage.

18. The system of claim 17 wherein the motor-vehicle component includes a vacuum servo booster.

19. The system of claim 17 wherein the engine includes a camshaft, and wherein the rotor is mechanically coupled to the camshaft.

* * * * *